US011670892B2

(12) United States Patent
Demaratos et al.

(10) Patent No.: US 11,670,892 B2
(45) Date of Patent: Jun. 6, 2023

(54) HIGH VOLTAGE VERTICAL DISK FERRULE, AND METHOD FOR ASSEMBLING THEREOF

(71) Applicant: J.S.T. CORPORATION, Farmington Hills, MI (US)

(72) Inventors: David Demaratos, Wixom, MI (US); Joshua Taylor, Farmington Hills, MI (US)

(73) Assignee: J.S.T. CORPORATION, Farmington Hills, MI (US)

( * ) Notice: Subject to any disclaimer, the term of this patent is extended or adjusted under 35 U.S.C. 154(b) by 190 days.

(21) Appl. No.: 17/101,997

(22) Filed: Nov. 23, 2020

(65) Prior Publication Data

US 2022/0021152 A1 Jan. 20, 2022

Related U.S. Application Data

(60) Provisional application No. 63/051,517, filed on Jul. 14, 2020.

(51) Int. Cl.
*H01R 13/53* (2006.01)
*H01R 13/6591* (2011.01)
(Continued)

(52) U.S. Cl.
CPC ..... *H01R 13/53* (2013.01); *H01R 13/405* (2013.01); *H01R 13/6583* (2013.01); *H01R 13/65912* (2020.08); *H01R 13/65914* (2020.08)

(58) Field of Classification Search
CPC .. H01R 11/28; H01R 13/6592; H01R 13/514; H01R 13/6591; H01R 13/582;
(Continued)

(56) References Cited

U.S. PATENT DOCUMENTS 4,382,653 A 5/1983 Blanchard
4,468,080 A * 8/1984 Van Brunt ..... H01R 13/6592 174/750

(Continued)

FOREIGN PATENT DOCUMENTS

EP 0295154 B1 6/1992

OTHER PUBLICATIONS

International Search Report for International Application No. PCT/US2020/066113 dated Mar. 31, 2021 (2 sheets).

*Primary Examiner* — Oscar C Jimenez
(74) *Attorney, Agent, or Firm* — Kratz, Quintos & Hanson, LLP

(57) ABSTRACT

A high voltage vertical disk ferrule, and method for assembling thereof, the ferrule being stamped and having a vertical disk-like structure, which is not necessarily round or does not necessarily have any roundness. The high voltage vertical disk ferrule has an opening residing and traveling over the wire core and/or a wire braided shield, to which an end portion of the wire braided shield is affixed to the ferrule, or between two ferrules, such that a portion of the wire braided shield is flared and substantially perpendicular to the direction along which the wire core extends. The high voltage vertical disk slides over the core insulation, and towards the outer insulation when the wire is pushed. The wire braided shield develops a natural spring force against the ferrule, and causes it to be accordioned, pleated, or folded against itself, and therefore pushes the vertical disk ferrule forward.

18 Claims, 8 Drawing Sheets

(51) Int. Cl.
*H01R 13/405* (2006.01)
*H01R 13/6583* (2011.01)

(58) Field of Classification Search
CPC ..... H01R 13/59; H01R 9/0518; H01R 43/28; H01R 4/20; H01R 4/029; H01R 13/405; H01R 13/53; H01R 13/65912; H01R 13/65914; H01R 13/6583
USPC ..... 439/607.41
See application file for complete search history.

(56) References Cited

U.S. PATENT DOCUMENTS

| | | | | |
|---|---|---|---|---|
| 6,452,102 | B1 * | 9/2002 | DeForest, Jr. ..... | H01R 13/405 174/750 |
| 8,771,013 | B2 * | 7/2014 | Kalayjian ..... | H01R 9/0518 439/585 |
| 9,865,942 | B2 * | 1/2018 | Hamada ..... | H01R 9/0518 |
| 10,193,281 | B1 * | 1/2019 | Rossman ..... | H01R 13/6584 |
| 2004/0102090 | A1 | 5/2004 | Styles | |
| 2013/0236139 | A1 | 9/2013 | Chen | |
| 2015/0332809 | A1 | 11/2015 | Natoli | |
| 2017/0215307 | A1 * | 7/2017 | Morgan ..... | H01R 9/0518 |

* cited by examiner

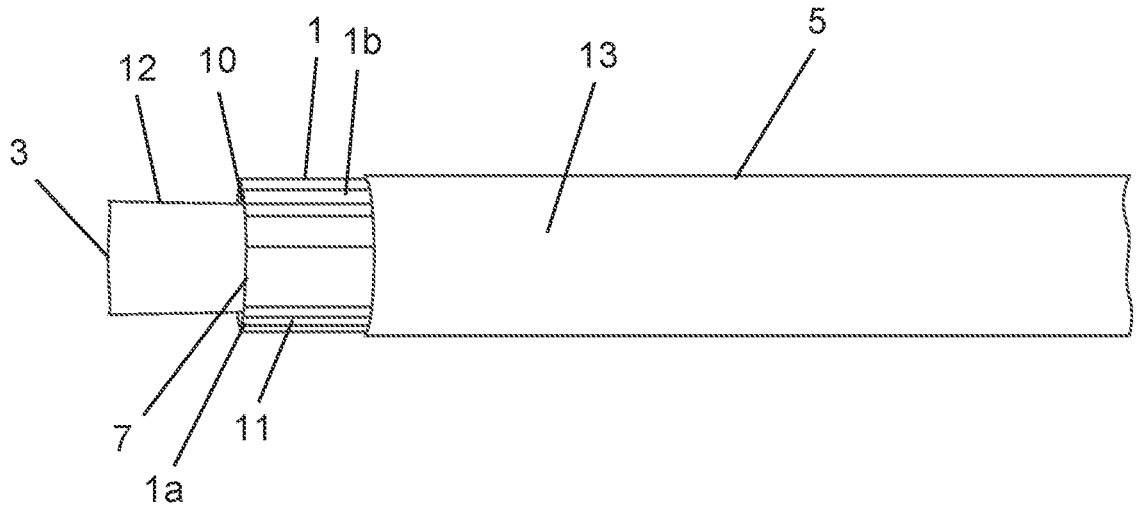
FIG.1A RELEVANT ART
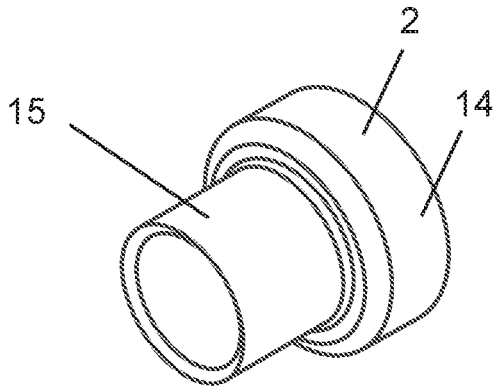
FIG. 1B RELEVANT ART

HIGH VOLTAGE VERTICAL DISK FERRULE, AND METHOD FOR ASSEMBLING THEREOF

CROSS-REFERENCE TO RELATED APPLICATION

This patent application claims priority to U.S. Provisional Patent Application No. 63/051,517 filed Jul. 14, 2020, which is hereby incorporated herein by reference in its entirety.

BACKGROUND OF THE INVENTION

Field of the Invention

The present invention generally relates to the field of electrical connectors, ferrules, and wire/cable shielding interfaces, which are useful in automotive or vehicle applications.

Description of the Related Art

In the automotive industry, a ferrule 1 in the relevant art, as shown in FIG. 1A, is understood to be a horizontal ferrule 1, horizontal or parallel to the direction of a wire core 3 of a wire 5. As such, the contact surface (i.e., between a connector and a wire shield) is parallel to the direction of a wire core 3. In the ferrule 1 of the relevant art, as shown in FIG. 1A, the horizontal ferrule 1 extends parallel to the direction of the corresponding wire core 3 as it is further and also crimped to the wire 5. As further shown in FIG. 1A, the horizontal surface 11 of the ferrule 1 of the relevant art is much larger (i.e., generally many orders of magnitude larger) than the vertical surface 7, which essentially constitutes the material thickness of the ferrule 1. Thus, the horizontal surface 11 constitutes the grounding surface of the ferrule 1 of the relevant art, which is horizontal (i.e., parallel to the wire core 3 thereof) and allows grounding or shielding features within a connector housing (not shown) to interact with the horizontal sides of the ferrule 1. In use, the ferrule 1 is crimped to a wire braided shield 10 and thus also secured to the wire 5 in the process.

Typically, it is the practice in the industry to use two ferrules (an inner ferrule and an outer ferrule), which sandwich therebetween the wire braided shield 10. This structural arrangement of the relevant art ensures the contact between the ferrule 1 and wire shield 10. The ferrule 1, shown in FIG. 1A, generally consists of two ferrules 1, an inner ferrule 1*a* and an outer ferrule 1*b*. The inner ferrule 1*a* is placed over the wire core insulation 12 and the wire braided shield 10 is folded or placed over its length (across the horizontal surface of the inner ferrule 1*a*). The outer ferrule 1*b* is then placed over the wire braided shield 10, aligned with the inner ferrule 1*a*, and crimped down. Thus, the crimping process of the ferrule 1 secures the inner and outer ferrules of the ferrule 1 to the wire braided shield 10. In use, and after crimping, the ferrule 1 also prevents the creep of the outer insulation 13 over time towards the wire core 3. The use of two ferrules 1 above the wire core insulation 12 also ensures the ferrule 1 and wire braided shield 7 do not cut through the wire core insulation 12 and ground out the power circuit.

Further, for its intended use in a connector housing (not shown), the ferrule 1 in FIG. 1A has to be of a sufficient length (typically 6-15 mm in length) to allow for tolerance stack up within the connector housing (not shown) and so that the two ferrules 1*a* and 1*b* are long enough so that they are guaranteed to be aligned on top of each other when being crimped. The tolerance stack up ensures that there is always contact between the ferrule 1 and the stamped metal shield (not shown) within the connector housing (not shown). However, the sufficient length of the ferrule 1 adds required corresponding length to the connector housing as well.

The ferrule 1 becomes fixed to a location relative to the corresponding wire 5 and corresponding outer insulation 13 of the wire 5 once the ferrule 1 is crimped. Once crimped, the ferrule 1 will then require sufficient force to move; therefore, this ferrule 1 of the relevant art is not designed to move or slide after crimping is completed. In other words, the ferrule 1 of the relevant art is structurally arranged so as not to move or slide along a wire core insulation 15 of the wire core 3. The crimped surface of the ferrule 1 will have ridges, valleys, and burrs, and will not remain in its uncrimped state or shape.

After the ferrule 1 of the relevant art has been crimped and assembled, it is typical for the need to provide an additional or a secondary cut to wire braided shield 10. The total exposed length of the wire braided shield 10 should not be more than twice the length of the ferrule 10. The problem arises if there is a possibility that a stray strand from the braided shield 10 contacts the power circuit of the wire 5 (wire core 3 or attached terminal (not shown)).

FIG. 1B illustrates the use of a flared ferrule 2. The flared ferrule 2 is comprised of a flared portion 14 having a major diameter, and is further comprised of a narrow portion 15 having a minor diameter and surrounds and contacts the wire shield 10. The narrow portion is the portion 15 that is crimped to the wire 5 the ferrule 1 of the relevant art is in use. The crimping of the narrow portion 15 to the wire 5 will limit the flared ferrule 2 from moving or sliding towards or over the outer insulation 13 when in use. The contact between the flared ferrule 2 and the shielding 10 provided in a connector housing (not shown) will happen at the flared portion 14, and its shape is largely unaltered after the crimping process which took place on the narrow portion 15.

Further, the ferrule 1 of the relevant art may be used with a stamped metal shield (not shown) having tabs. The tabs (not shown) contact the ferrule 1 on its horizontal face 1*b* and create grounding contact between the ferrule 1 and the shield. The horizontal face 1*b* of the ferrule 1 is parallel to the direction of wire 5 insertion. The ferrule 1 requires adequate space inside a connector housing (not shown) required to fully house the ferrule 1 and allow contact between the ferrule 1 and shield. The space required is required to be large enough to fit the terminal (not shown) through, which is often larger than the size of the vertical face 1*b* of the ferrule 1. Therefore, there is little to no EMI coverage or cover provided by the ferrule 1.

It is also desired that the structure or structural arrangement of the ferrule can provide complete or substantial EMI coverage by covering the hole in a respective housing which allows for full coverage inside the opening of the respective connector housing which it is being used with, as well as a ferrule, which when affixed with a wire braided shield, does not require a secondary cut which therefore minimizes or reduces the likelihood that stray strands of the wire braided shield (ground circuit) contacting the wire core (power circuit), and also a ferrule that provides a forgiving take up or tolerance to enhance the assembly method thereof.

SUMMARY OF THE INVENTION

This invention is a high voltage vertical disk ferrule, and a method for assembling thereof. More particularly, the high voltage vertical disk ferrule of this invention is a vertical disk-like structure, but the disk-like structure is primarily made of flat surfaces and the perimeter, edge, or vertical shape or constraint is not necessarily round or does not necessarily have any roundness. The high voltage vertical disk ferrule of this invention is an electrically conducting device with an aperture or opening at the center thereof. The aperture or hole will reside over the wire core and a wire braided shield, to which an end portion of the wire braided shield is affixed thereto the high voltage vertical disk ferrule, or between the ferrules, such that a portion of the wire braided shield is flared and substantially perpendicular to the direction of the wire core. The aperture or hole at the center of the high voltage vertical disk ferrule of this invention accommodates therein a wire core, wire core insulation, and\or a wire braided shield; the wire braided shield lying over the wire core insulation.

The vertical disk ferrule of this invention slides over the core insulation, once affixed to the wire braided shield, towards the point or location where the outer insulation is cut (vertical surface of the outer insulation). This assembling method pushes back the wire braided shield and allows for the wire braided shield to develop a natural spring force against the vertical disk ferrule, and the wire braided shield becomes in the condition or state where it has accordioned, pleated, or folded against itself, and therefore pushes back against the direction the ferrule has traveled along the wire core when the wire is being pushed, so as to push the vertical disk ferrule forward (towards the cut end of the wire or terminal that is attached thereto). This force will allow the vertical disk ferrule or wire braided shield, if therebetween, to remain in contact with the grounding structure of the connector when in use or when as a single ferrule, pushes the wire braded shield against the housing or ferrule when in use.

The ability for the disk-like structure or structural arrangement of this invention to take on any shape to which it can be stamped will also allow for it to provide complete or near complete electromagnetic interference (EMI) coverage in use with a corresponding connector housing which may require a specific shape, and which will further allow for little or no escape path for the EMI by covering the aperture or hole through which the wire or terminal is placed into when in use with such corresponding housing in which the wire or terminal is inserted into, unlike in conventional ferrules and conventional stamped shields which may allow for EMI escape.

The vertical disk ferrule of this invention also provides for an adequate clearance between the wire core or terminal (power circuit), and the wire braid shield or ferrule (grounding circuit), while also limiting the likelihood of contact between the power circuit and grounding circuit in the process by also limiting the likelihood of stray strands of the wire braid shield from contacting the power circuit.

BRIEF DESCRIPTION OF THE DRAWINGS

FIG. 1A is a side elevational view of a connector assembly using a typical crimped ferrule and wire assembly in the relevant.

FIG. 1B is a perspective view of a typical crimped ferrule design having a flared portion in the relevant art.

DETAILED DESCRIPTION OF THE PREFERRED EMBODIMENTS

Figure 2:
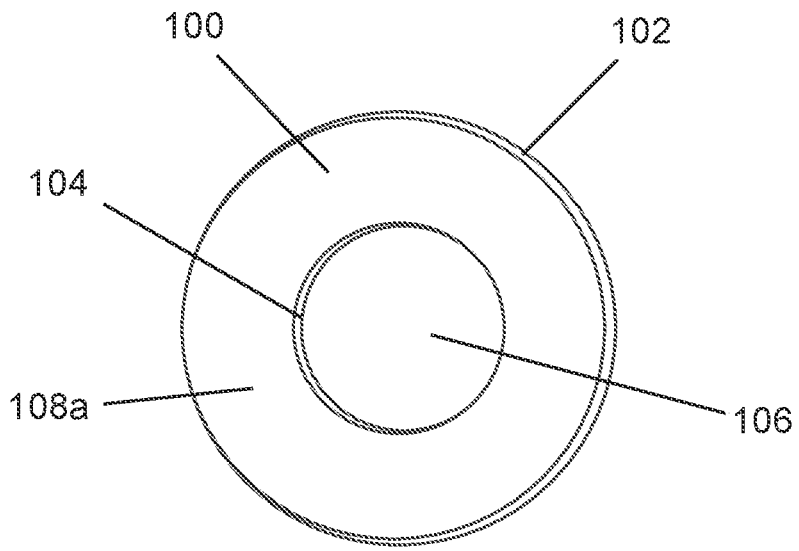
FIG. 2 is a front elevational view of the high voltage vertical disk ferrule of the present invention.

Shown in FIG. 2 is a high voltage vertical disk ferrule 100 of the present invention. The vertical disk ferrule 100 may be made of any electrically conducting material (such as, but not limited to, copper, tin plated copper, steel, brass alloy, bronze, or the like, or any like-kind of conductive metal known in metallurgy). The high voltage vertical disk ferrule 100 of this invention is comprised of an outer edge 102, an inner edge 104, defining an opening or aperture 106, and additionally a front face 108*a* which is flat, and a back face 108*b* which is also flat. As more precisely shown in FIG. 3, the outer edge 102 and the front face 108*a* meet perpendicularly, and similarly, the outer edge 102 and the rear face 108*b* meet perpendicularly. Furthermore, the inner edge 104 and the front face 108*a* meet perpendicularly, and similarly, the inner edge 104 and the rear face 108*b* meet perpendicularly. Thus, the distance or length of the outer edge 102 and the inner edge 104, in a direction parallel, or axial to the wire 200 as shown in FIG. 3A, defines the thickness or length of the high voltage vertical disk ferrule 100 of this invention.

Further, the vertical disk ferrule 100 of this invention is shown in FIG. 2 as a vertical disk-like structure, being a round, circular shape, although, the form is not limited thereto. The disk-like structure is primarily made of the vertical flat surfaces of the front face 108*a* and back face 108*b* and the perimeter, edge, or vertical shape constraints of the outer edge 102 is not necessarily formed to become round or does not necessarily have any roundness and is further able to take on any shape to which it can be stamped. For example, the shape of the vertical disk ferrule 100 could take the form of an oval, ellipse or any other shape allowable by stamping means which define the outer edge 102. Preferably, the shape of the vertical disk ferrule 100 will provide complete or substantial coverage over a corresponding hole or aperture (not shown) in a connector housing into which a related wire 200 or terminal 300 (see, e.g., FIGS. 6A-6*d*) is attached and is required to pass through which is being used with the vertical disk ferrule 100. Thus, the shape of the vertical disk ferrule 100 will allow for it to provide complete or substantial electromagnetic interference (EMI) suppression or coverage when in use with a corresponding connector housing 400 (see, e.g., FIGS. 6A-6D). The housing 400 itself may require the vertical disk ferrule 100 to be a specific shape to fit into a recess or cavity thereof (not shown).

Figure 3:
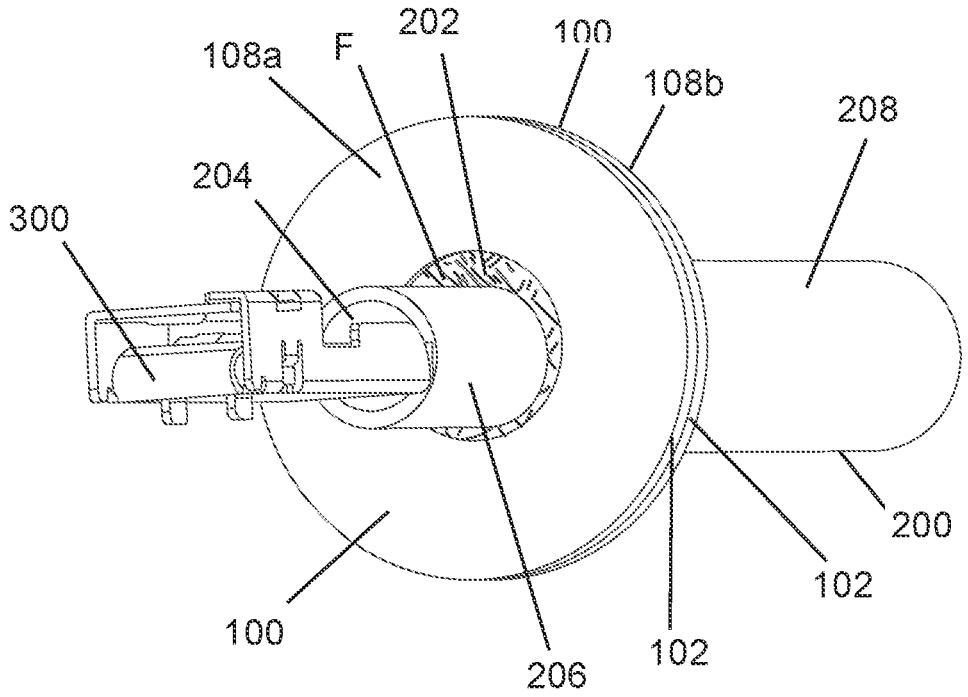
FIG. 3 is a perspective view of the high voltage vertical disk ferrule of the present invention using two high voltage vertical disk ferrules of the present invention fully assembled with a wire.

Illustrated in FIG. 2 or FIG. 3 is the circular shaped vertical disk ferrule 100, having its front face 108*a* and its back face 108*b* radiate outward, vertically, from its opening 106 and the respective wire 200 which is inserted and accommodated through the opening 106. The wire is comprised of a wire core portion 204, wire core insulation 206, wire braided shield 202, and outer wire insulation 208. As previously discussed, the front face 108*a* and back face 108*b* of the vertical disk ferrule 100 are preferably generally perpendicular to the axial direction of the wire 200. The diameter or size of the front face 108*a* and back face 108*b* are such that the vertical disk ferrule 100 is large enough to cover a hole in a respective housing 400 (see, e.g., FIGS. 5A-5C or FIGS. 6A-6E), wherein the hole is large enough to accommodate a terminal 300 and a respective portion of the wire core 204 and or wire core insulation 206. Therefore, the size of the front face 108*a* and back face 108*b* of the high voltage vertical disk ferrule 100 is not limited, and their respective sizes would however need to be such that they are not less than the size of the outer insulation 208 of the wire 200, so that the vertical disk ferrule 100 may have an inner edge 104 defining an opening 106 for the vertical disk ferrule 100, which is adequately sized for proper use with the respective wire 200 size, while the vertical disk ferrule 100 has adequate surface on the front face 108*a* and back face 108*b* for proper grounding with a grounding feature and properly functions when in use, the wire 200 remaining flexible behind the ferrule 100). The opening 106 of the vertical disk ferrule 100 is also of a size that allows the vertical disk ferrule 100 to move freely over a wire braided shield 202 of the wire 200, if required, as will be discussed later.

The vertical disk ferrule 100 contacts with respective grounding elements in a respective housing 400 (see, FIGS. 5A-5C or FIGS. 6A-6E) at its front vertical face 108*a* or in combination with its front vertical face 108*a* and wire braided shield 202 when used as a single ferrule 100 with the flared portion F of the wire braided shield 202 therebetween. The grounding elements in a respective housing 400 may be, for example, plated surfaces, a traditional stamped shield, foil lined surfaces, or other conductive materials utilized within, on, or by the housing 400 for grounding purposes. The outer edge 102 of the vertical disk ferrule 100 may also make contact with the grounding elements of a respective housing 400, if so desired.

The thickness of the vertical disk ferrule 100, in an axial direction, is defined by the length of the outer edge 102, preferably no more than 1 mm (however, the size and or length thereof is not limited thereto); and the preferred thickness of the vertical disk ferrule 100 in the axial direction is kept thin enough to provide for less required space in a respective connector housing compared to that in a conventional crimped ferule, being thinner or shorter than a conventional crimped ferrule, and also allowing adequate take-up of the wire 200, as will be discussed further below. The thickness of the vertical disk ferrule 100 further preferably accommodates the vertical disk ferrule 100 within a recess in a respective connector housing 400 such that the vertical disk ferrule 100 resides within a portion of a respective connector housing 400 if needed, and thereby providing a much shorter design for the connector housing 400 than conventional ferrules required in the method of assembling. The vertical disk ferrule 100 may also be accommodated on the exterior of a respective connector housing 400 by substantially abutting a surface or side thereof the connector housing 400 (see, e.g., FIGS. 6A, 6B, and 6D).

Figure 4A:
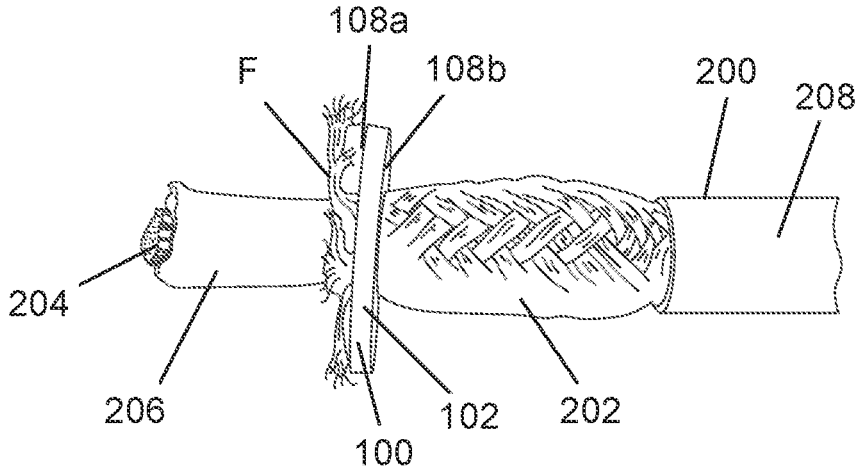
FIG. 4A is a side elevational view of the high voltage vertical disk ferrule of the present invention assembled with a wire and a flared portion of a wire braided shield affixed on the front face of the high voltage vertical disk ferrule.

As illustrated in FIG. 4A, the vertical disk ferrule 100 is placed along the wire braided shield 202 of the wire 200. Here, as previously discussed, both the front face 108*a* and rear face 108*b* of the vertical disk ferrule 100 are preferably substantially perpendicular to the axial direction of the wire 200. The wire braided shield portion 202 can therefore be affixed to the front face 108*a* by being flared outward forming a flared portion F radiating away from a core insulation portion 206, substantially perpendicular to the lengthwise direction of the wire 200 (see also, FIG. 6A).

Figure 4B:
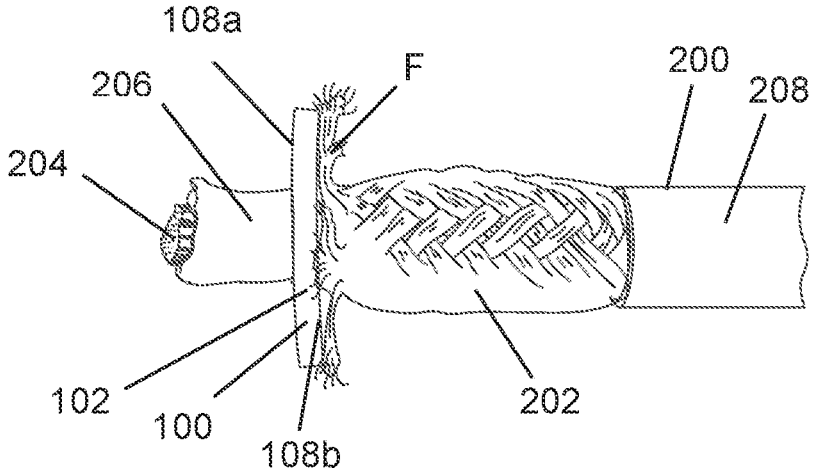
FIG. 4B is a side elevational view of the high voltage vertical disk ferrule of the present invention assembled with the wire and the flared portion of the wire braided shield affixed on the rear face of the high voltage vertical disk ferrule.
Figure 6A:
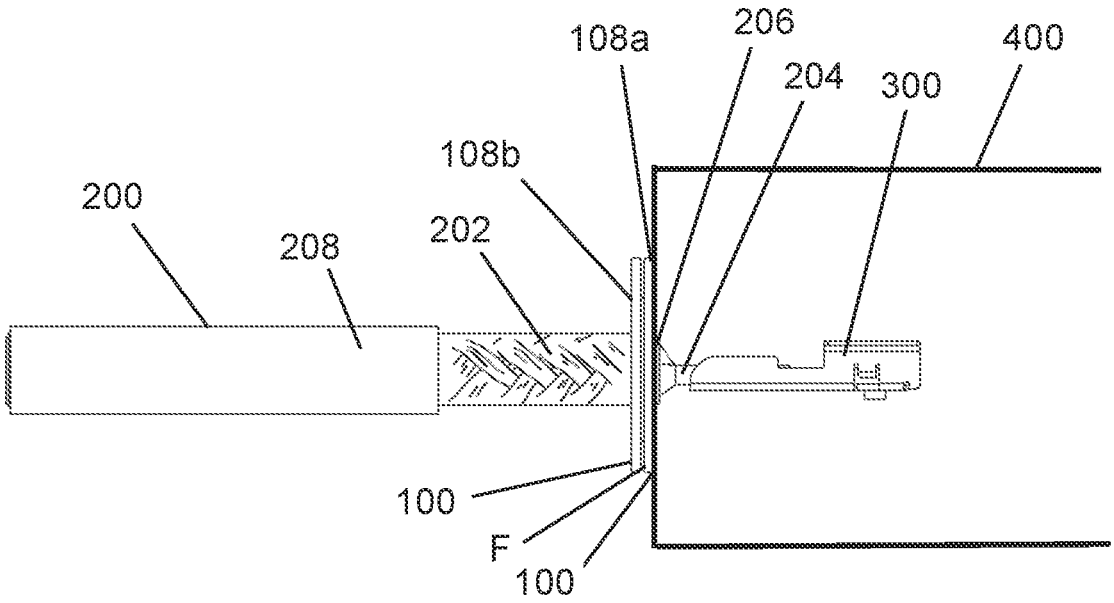
FIG. 6A is a side elevational view of the high voltage vertical disk ferrule of the present invention using the two high voltage vertical disk ferrules of the present invention and fully assembled with the wire, the wire being inserted into the corresponding connector housing.
Figure 6B:
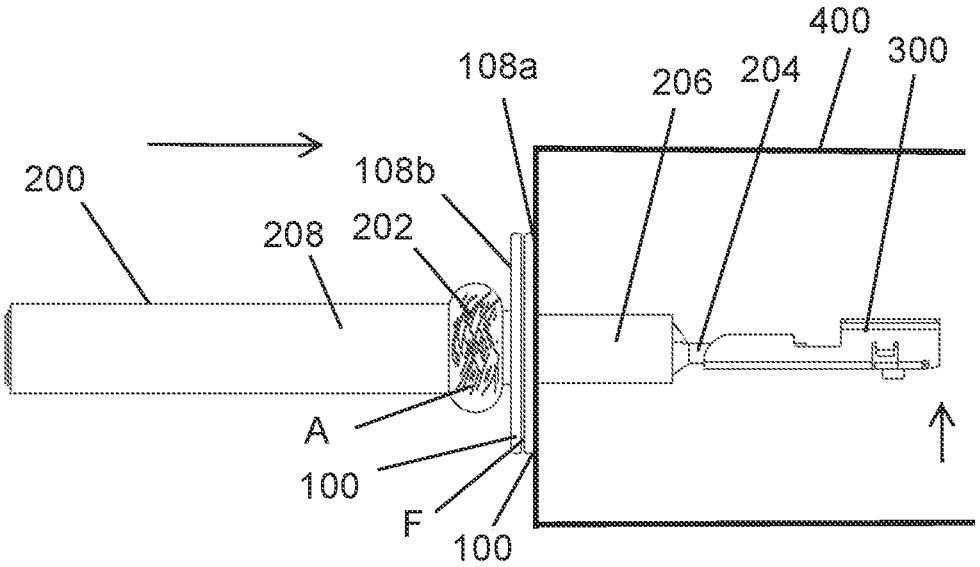
FIG. 6B is a side elevational view of the high voltage vertical disk ferrule of the present invention using the two high voltage vertical disk ferrules of the present invention and fully assembled with the wire, the wire being fully inserted into the corresponding connector housing.
Figure 6C:
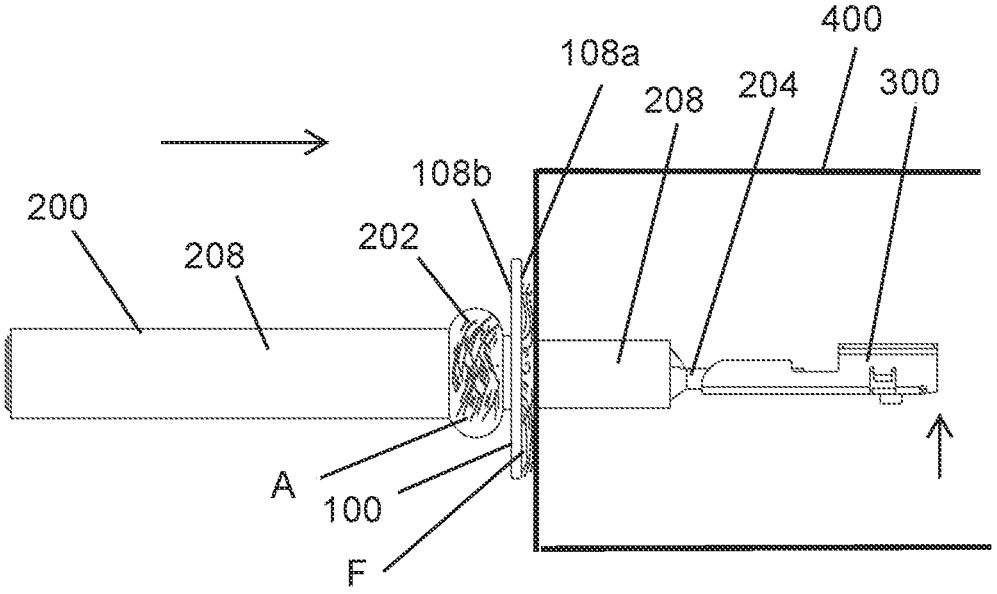
FIG. 6C is a side elevational view of the high voltage vertical disk ferrule of the present invention using a single high voltage vertical disk ferrule of the present invention and fully assembled with the wire, and the flared portion of the wire braided shield affixed on the front face of the high voltage vertical disk ferrule, the wire being fully inserted into the corresponding connector housing.
Figure 6D:
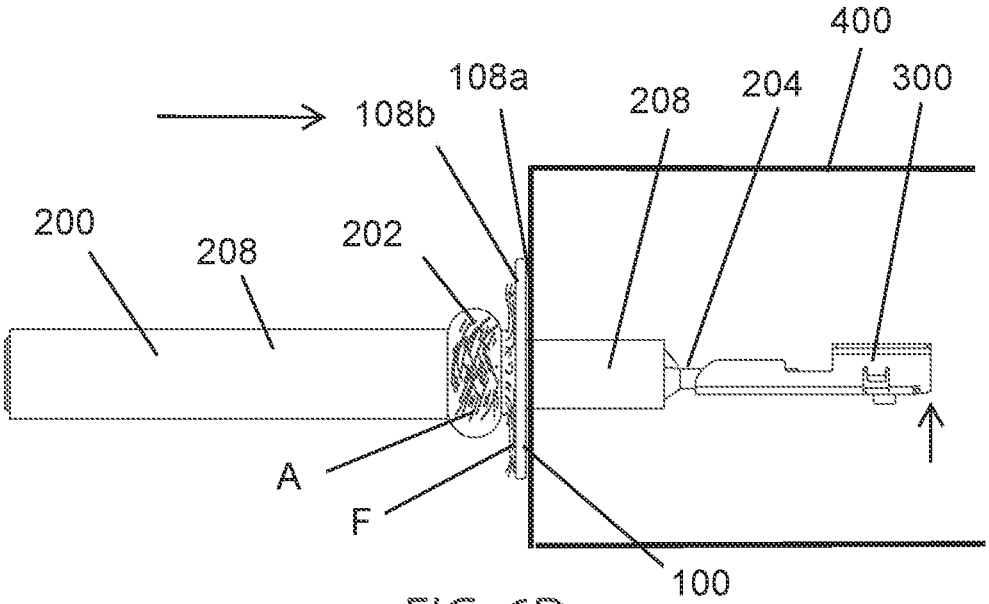
FIG. 6D is a side elevational view of the high voltage vertical disk ferrule of the present invention using the single high voltage vertical disk ferrule of the present invention and fully assembled with the wire, and the flared portion of the wire braided shield affixed on the rear face of the high voltage vertical disk ferrule, the wire being fully inserted into the corresponding connector housing.

Likewise, in FIG. 4B, the flared portion F of the wire braided shield portion 202 can also be affixed to the rear face 108*b* of the vertical disk ferrule 100 (see also, FIG. 6D). Both structural arrangements or methods allow the wire braided shield portion 202 of the wire 200 to be secured in a manner that the wire shield 202 is in conductive electrical contact with the front 108*a* or rear 108*b* face of the vertical disk ferrule 100. Here, advantageously, the wire braided shield 202 does not require further secondary cutting once the vertical disk ferrule 100 is in a position where the wire braided shield 202 does not extend past, radially, away from the front 108*a* or rear 108*b* face of the vertical disk ferrule 100, whether using a single vertical disk ferrule 100 or using two vertical disk ferrules 100.

In an assembling method of this invention where the wire 200 is pushed into and through the vertical disk ferrule 100, this method pushes back the wire braided shield 202 and allows for the wire braided shield 202 to develop a natural spring force against the vertical disk ferrule 100 (rearmost vertical disk ferrule 100 if two vertical disk ferrules 100 are used), and the wire braided shield 202 becomes in the condition or state where it has accordioned, pleated, or folded against itself (see, FIG. 5C), and therefore pushes back against the direction the vertical disk ferrule 100 has traveled along the wire core 204 when the wire 200 is being pushed, so as to push the vertical disk ferrule 100 forward (or towards the cut end of the wire 200 or terminal 300 attached thereto). This force will allow the vertical disk ferrule 100 and or wire braided shield 202, if in between the vertical disk ferrule 100 and the connector housing 400, to remain in contact with the grounding structures of the connector housing 400. If a single vertical disk ferrule 100 is used, the force pushes the vertical disk ferrule 100 against the wire braded shield 202, which abuts against the grounding feature or housing 400.

Figure 4C:
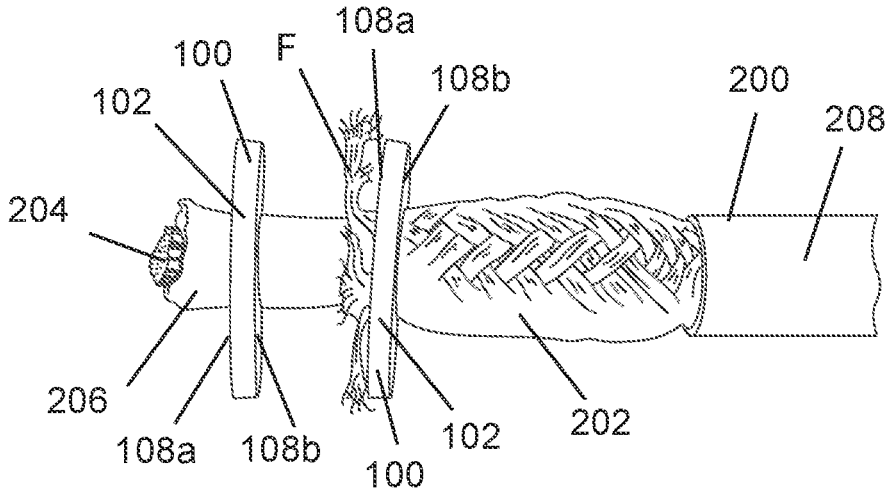
FIG. 4C is a side elevational view of the high voltage vertical disk ferrule of the present invention using two high voltage vertical disk ferrules of the present invention with the wire.
Figure 4D:
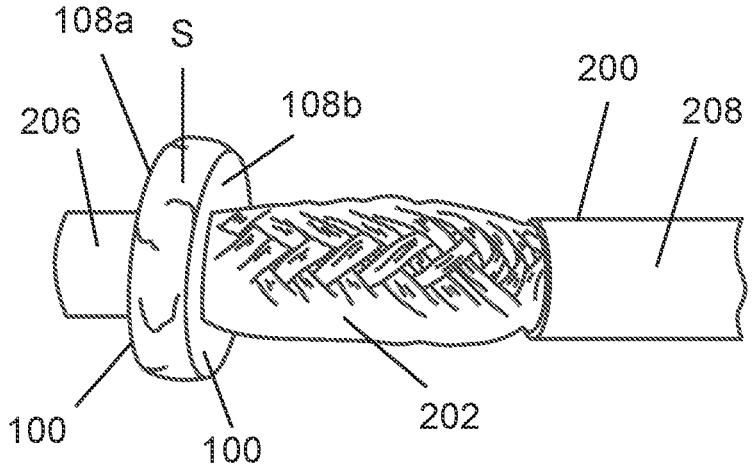
FIG. 4D is a side elevational view of the high voltage vertical disk ferrule of the present invention using two high voltage vertical disk ferrules of the present invention soldered together and fully assembled with the wire.

Shown in FIG. 4C or FIG. 4D is the preferable use of two vertical disk ferrules 100. The use of two vertical disk ferrules 100, a first vertical disk ferrule 100*a* and a second vertical disk ferrule 100*b*, provides the ability to sandwich the wire braided shield 202 of the wire 200 in between the front face 108*a* of the first vertical disk ferrule 100*a* and the rear face 108*b* of the second vertical disk ferrule 100*b*. The first vertical disk ferrule 100*a*, as shown in FIG. 4C, is placed over the wire braided shield portion 202, such that the flared portion F of the wire braided shield 202 is then contacted by the front face 108*a* of the first vertical disk ferrule 100*a* and then the rear face 108*b* of the second vertical disk ferrule 100*b* makes contact with the flared portion F as it is inserted over, and eventually residing over, the wire core insulation 206, preferably not making contact with the wire core 204 when in use (see, FIGS. 6A and 6B). The above-described structural arrangement provides adequate contact between the flared portion F of the wire braided shield 202 and the first vertical disk ferrule 100*a* and second vertical disk ferrule 100*b*, and further provides an adequate continuity to the wire braided shield 202 from both vertical disk ferrules 100 when in use. Solder (shown as S) or other mechanical, or electro-mechanical means may be used to further stabilize or promote the sandwiching or insertion of the wire braided shield 202 flared portion F, and to secure the structural arrangements or relationships of these parts for complete continuity, as further discussed below.

When using two vertical disk ferrules 100, it may further or optimally be desired to securely affix the two vertical disk ferrule 100 together in order to retain and keep the wire braided shield 202 inserted or sandwiched therebetween, as discussed above. It is preferred that mechanical, or electro-mechanical means are used to connect the two vertical disk ferrules 100 for adequate operation of the two vertical disk ferrule 100. For example, solder (shown as reference S in FIG. 4D), welding (resistive, spot, ultrasonic, or the like), or brazing are electro-mechanical methods that can be used to connect the respective metals which comprise the two vertical disk ferrules 100. Also, a mechanical bond using a press fit or snap fit may be used. As shown in FIG. 4D, a solder S is applied to provide the means which keeps the first vertical disk ferrule 100*a* and second vertical disk ferrule 100*b* affixed together and the wire braided shield 202 secured therebetween. The means of securing the two vertical disk ferrules 100 together provides and promotes an adequate conductive and or physical substrate to connect the second vertical disk ferrule 100*b* to the first vertical disk ferrule 100*a*, and therefore assures the conductive connection and contact of the two vertical disk ferrules 100 to the wire braided shield 202 when or if the second vertical disk ferrule 100*b* makes contact with a grounding structure in the corresponding housing 400. Additionally, when a single vertical disk ferrule 100 is used, the wire braided shield 202 and vertical disk ferrule 100 may be soldered together to ensure that they are fixed and secured in combination (soldered either on the front face 180*a* or back face 108*b*), and that their movement together as a unit is synchronized (see, FIGS. 5A-C or FIGS. 6A-B).

In FIGS. 6A and 6B, the use of a terminal 300 on the wire 200 are shown. The terminal 300 is secured to the end of the wire 200 by being fixedly attached (e.g., soldered) to a wire core portion 204 of the wire 200. FIG. 6A shows the use of two vertical disk ferrules 100, however, FIGS. 6C and 6D are not limited thereto and the replacement and use of a single vertical disk ferrule 100 can be similarly applied in the structure, structural arrangement, or method of this invention, as illustrated, and as further discussed below. For example, when two vertical disk ferrules 100 are used, one rides over the wire shield 202 (first vertical disk ferrule 100*a*) and the other (second vertical disk ferrule 100*b*) rides over the core insulation 206. When one single vertical disk ferrule 100 is used and the wire shield 202 is fixed or against the front face 108*a* of the vertical disk ferrule 100, the vertical disk ferrule 100 rides over the wire shield 202. Additionally, when one single vertical disk ferrule 100 is used and the wire shield 202 is fixed or against the back face 108*b* of the vertical disk ferrule 100, the vertical disk ferrule rides over the wire core insulation 206.

Figure 5A:
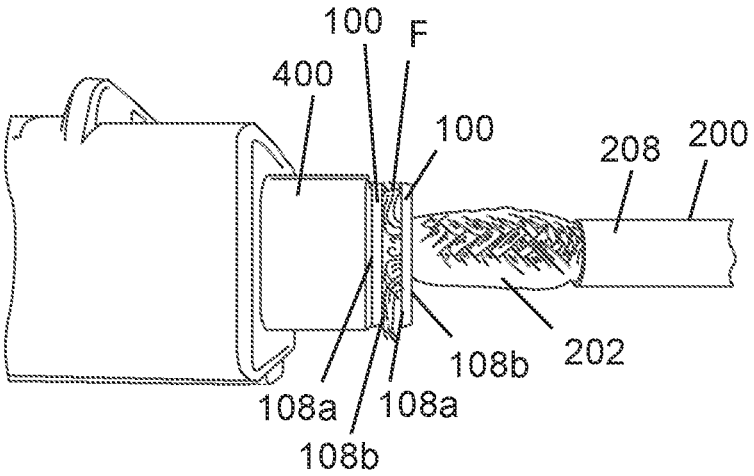
FIG. 5A is a side elevational view of the high voltage vertical disk ferrule of the present invention using two high voltage vertical disk ferrules of the present invention and fully assembled with the wire, the wire being inserted into a corresponding connector housing.
Figure 5B:
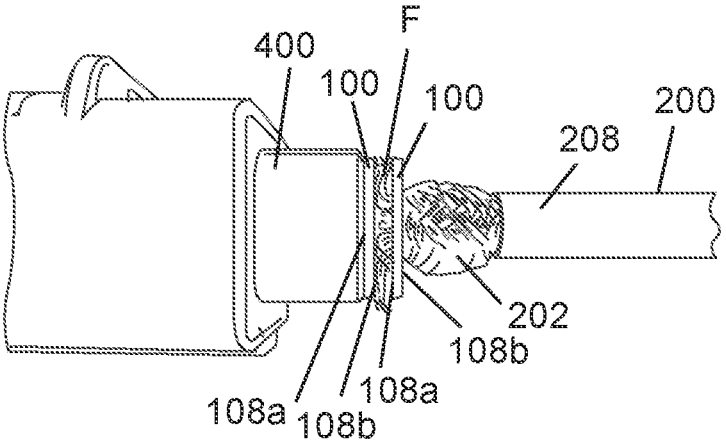
FIG. 5B is a side elevational view of the high voltage vertical disk ferrule of the present invention using the two high voltage vertical disk ferrules of the present invention and fully assembled with the wire, the wire being further inserted into the corresponding connector housing.
Figure 5C:
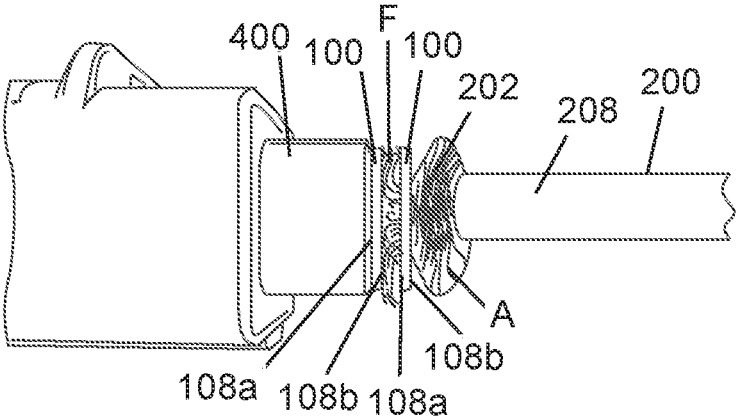
FIG. 5C is a side elevational view of the high voltage vertical disk ferrule of the present invention using the two high voltage vertical disk ferrules of the present invention and fully assembled with the wire, the wire being fully inserted into the corresponding connector housing.

As seen in FIG. 6A, the wire braided shield portion 202 of the wire 200 is affixed between two vertical disk ferrules 100. The vertical disk ferrule 100 cannot move along the wire 200 towards the terminal 300 in an axial direction along the wire 200, since the wire shield 202 is extended fully in such a direction that a portion of the wire shield 202 is flat along the insulation 206 of the core portion 204 and the flared end F of the wire braided shield portion 202 is secured and affixed from moving from its position between the two vertical disk ferrules 100. However, the two vertical disk ferrules 100 are movable in an axial direction towards a vertical surface of the the outer wire insulation portion 208, and away from the cut end of the wire 200 or attached terminal 300. The first vertical disk ferrule 100*a* rides over the wire shield 202 and the second vertical disk ferrule 100*b* rides over the core insulation 206. In this method of the invention, the wire 200 extends through the opening 106 of both vertical disk ferrules 100, during what is considered to be the "take-up", which includes the bunching or accordioning (A) of the wire shield 202, which is due to the slack or tolerance for movement of the wire core 204 as it further relates to the exposed length of the shield 202 (see also, FIGS. 5A and 5B). The shield 202 becomes bunched up onto the side of the two vertical disk ferrules 100 opposite the side which the terminal 300 and wire core 204 extend. As the two vertical disk ferrules 100 move along the axial direction of the wire 200, and parallel to the wire 200, the wire core 204 extends, moves along, and through the openings 106 of the two vertical disk ferrule 100. The wire braided shield portion 202 becomes consequently bunched up, or accordioned, as shown by reference letter A, into itself as the "take-up" of the wire 200 occurs. The wire braided shield 202 is bunched up from where it is exposed at the outer insulation 208 of the wire 200 to where it may contact the rear face 108*b* of the first vertical disk ferrule 100. As seen in FIG. 6B, once the wire braided shield portion 202 has become bunched or accordioned, this bunched or accordioned portion A of the wire shield 202 provides a force against the rear face 108*b* of the first vertical disk ferrule 100 since the wire braided shield 202 becomes pressed onto itself and is compressed while being up against the vertical disk ferrule 100. Thus, as seen in FIGS. 5A and 5B, this accordioned portion A of the wire braided shield portion 202 provides a spring-like force against the first vertical disk ferrule 100*a* when the wire 200 is in this structural arrangement. The force provided by the wire shield 202 provides or assures that the second vertical disk ferrule 100*b* is pressed against a surface of the housing 400 and or against respective shielding means incorporated with the connector housing 400, while the second vertical disk ferrule 100*b* also adequately covers an opening or aperture (not shown) in the housing 400 (see, e.g., FIGS. 5C, 6A, and 6B).

Also illustrated in FIG. 6B is a full extension or exposure of the wire core portion 204 from the wire braided shield 202, and the wire core portion 204 has moved through the opening 106 of the vertical disk ferrule 100, reaching a point which allows the wire core portion 204 and terminal 300 to extend away from the vertical disk ferrule 100 and allow for the "take-up" process to fully complete. The wire core portion 204 and insulation 206 of wire core portion 204 are moved through the openings 106 of the two vertical disk ferrule 100 along the wire's 200 axial direction, as previously discussed. The wire braided shield 202 is secure between the two vertical disk ferrules 100; thus, the bunched up or accordioned portion A of the wire braided shield 202 is coordinated with the movement of the wire 200 into the housing 400, when the outer insulation 208 of the wire 200 moves towards the two vertical disk ferrules 100 and one of the vertical disk ferrules 100 abuts against the housing 400, or the two vertical disk ferrules 100 have been immobilized in some other fashion. Similarly, the wire braided shield 202 is bunched or accordioned in the space between the vertical disk ferrule 100 and the outer insulation 208, whereby the wire braided shield 202 exposed portion extends along the wire core insulation 206 and an end (flared portion F) is between the two vertical disk ferrules 100.

Also, as illustrated in FIG. 6B, the extension of the terminal 300 into the housing 400 is limited by a forward stop F. The forward stop F is a surface or feature of the housing 400, which limits the travel of the terminal 300 into the housing 400 while the terminal 300 is being pushed or inserted thereinto. When the terminal 300 touches or abuts the forward stop F, it is also preferable that the terminal 300 is immobilized by means between the housing 400 and terminal 300, which secures, locks, or fastens the terminal 300 with the housing 400. A secured, locked, or fastened terminal 300 prevents (see, FIG. 6B) or assures the terminal 300 and the attached wire core portion 204 does not inadvertently exit from or be removed from the housing 400 in a direction opposite the direction of insertion of the terminal 300. The above-described structural arrangements of this invention or methods for assembling thereof further assure that the accordion A condition of the wire braided shield portion 202 is maintained, which exists when the terminal 300 is at its most forward or locked position. Additionally, the assurance of the terminal 300 and wire core portion 204 from moving in a direction opposite the insertion of the terminal 300 into the housing 400, assures that a subsequent adequate force from the accordion A is provided in a spring-like manner to the two vertical disk ferrules 100, and is subsequently not reduced, so that the second vertical disk ferrule 100 maintains contact with the housing 400 and contacts respective grounding structural arrangements or features. If the terminal 300 and wire core portion 204 are allowed to be extracted or be removed from the housing 400, the bunched or accordioned portion A of the wire braided shield 202 may not be maintained if the wire core portion 204 slides or moves rearward or in the direction opposite of mating of the terminal 300, and the terminal 300 itself, or housing 400 itself. Therefore, if the wire core portion 204 slides or moves through the opening 106 of the vertical disk ferrule 100, in the opposite direction, the lengthening or return of the wire braided shield 202 in the axial direction of the wire 200 to the relaxed condition before the terminal 300 was inserted, will not provide the adequate accordion A condition. Thus in its returned condition similar to FIG. 6A, it will no longer have the accordion A condition seen in FIG. 6B. Thus, it is preferable that after the vertical disk ferrule 100 contacts the housing 400, that the securing of the terminal 400 by or with the housing 400 is accomplished, and the wire braided shield portion 202 will therefore be providing a spring-like force against a portion of the vertical disk ferrule 100 opposite a portion of the vertical disk ferrule 100 or additional vertical disk ferrule 100 which makes contact with the housing, further keeping or maintaining the contact between the vertical disk ferrule 100 and the housing 400 and respective grounding structural arrangements or features.

As illustrated in FIG. 6C, the wire braided shield 202 flared portion F of the wire 200 is affixed to the front face 108*a* of a single vertical disk ferrule 100. Once the flared portion F of the wire braided shield 202 is attached, the vertical disk ferrule 100 cannot move along the wire 200 further forward towards the terminal 300 in an axial direction along the wire 200, since the wire shield 202 is extended or stretched fully in such a direction that a portion of the wire shield 202 is taught and flat along the wire core insulation 206 of the core portion 204 and the flared end F of the wire braided shield 202 is secured and affixed from moving from its position on the vertical disk ferrule 100, and may be further affixed to the front face 108*a* of the vertical disk ferrule 100 using solder. Further, the wire shield 202 may also not be secured or affixed to the vertical disk ferrule 100, however it will likewise move away from the flared end F of the wire braided shield portion 202. However in the affixed condition with the wire shield 202, the single vertical disk ferrule 100 is movable in an axial direction towards a vertical portion of the outer wire insulation 208, and away from the cut end of the wire or attached terminal 300. Thus, when one single vertical disk ferrule 100 is used and the wire shield 202 is fixed or against the front face 108*a* of the vertical disk ferrule 100, the vertical disk ferrule 100 rides over the wire shield 202. In this method of the invention, the wire extends through the opening 106 of the vertical disk ferrule 100, during what is considered to be the "take-up", which includes the bunching or accordioning of the portion A of the wire shield 202, which is due to the slack or tolerance for movement of the wire core 204 as it further relates to the exposed length of the shield 202. The shield 202 becomes bunched up onto the side of the vertical disk ferrule 100 opposite the side which the terminal 300 and wire core 204 extend, which is from the front face 108*a*. As the vertical disk ferrule 100 moves along the axial direction of the wire 200, along the wire shield 202, and parallel to the wire 200, the wire core 204 extends, moves along, and through the opening 106 of the vertical disk ferrule 100. The wire braided shield 202 consequently bunches up, or accordions, as shown by the reference letter A, into itself as the "take-up" of the wire 200 occurs. The wire braided shield 202 is bunched up from where it is exposed at the outer insulation 208 of the wire 200 to where it may contact the rear face 108*b* of the vertical disk ferrule 100. As shown in FIG. 6C, once the wire braided shield 202 has become bunched or accordioned, as in portion A, this portion A of the wire shield 202 provides a force against the rear face 108*b* of the vertical disk ferrule 100 since the wire shield 202 is now pressed onto itself and is compressed while abutted against the vertical disk ferrule 100. Thus, more specifically, the wire braided shield 202 is bunched or accordioned in the space between the vertical disk ferrule 100 and the outer insulation 208, whereby the exposed portion of the wire braided shield 202 is extending along the wire core insulation 206 and an end (flared portion F) is between the vertical disk ferrule 100 and housing 400. Thus, this accordioned portion A of the wire braid shield 202 provides a spring-like force against the vertical disk ferrule 100 when the wire 200 is in this condition. The spring force provided by the wire shield 202 provides or assures that the front face 108*a* of the vertical disk ferrule 100 is pressed against and contacts the flared portion F of the wire shield 202, or if the wire shield 202 is further affixed or soldered, that the wire shield 202 is ensured to make adequate contact with the surface of the housing 400 and against such respective shielding means (not shown) inside or of the housing 400, while the vertical disk ferrule 100 further and also adequately covers an opening or aperture (not shown) in the housing 400.

An additional structural arrangement, as shown in FIG. 6D, the wire braided shield 202 flared portion F of the wire 200 is affixed to the back face 108*b* of a single vertical disk ferrule 100. Once the flared portion F of the wire braided shield 202 is attached, the vertical disk ferrule 100 cannot move along the wire 200 further forward towards the terminal 300 in an axial direction along the wire 200, since the wire shield 202 is extended or stretched fully in such a direction that a portion of the wire shield 202 is taught and flat along the insulation 206 of the core portion 204 and the flared end F of the wire braided shield portion 202 is secured and affixed from moving from its position on the vertical disk ferrule 100, and may be further affixed to the back face 108*b* of the vertical disk ferrule 100 using solder. Further, the wire shield 202 may also not be secured or affixed to the vertical disk ferrule 100, however it will likewise move away from the flared end F of the wire braided shield portion 202. However in the affixed condition with the wire shield 202, the single vertical disk ferrule 100 is movable in an axial direction towards the outer wire insulation portion 208, and away from the cut end of the wire or attached terminal 300. Thus, when one single vertical disk ferrule 100 is used and the wire shield 202 is fixed or against the back face 108*b* of the vertical disk ferrule 100, the vertical disk ferrule 100 rides over the wire core insulation 206 and does not ride over the wire shield 202. In this process, the wire 200 extends through the opening 106 of the vertical disk ferrule 100, during what is considered to be the "take-up", which includes the bunching or accordioning (A) of the wire shield 202, which is due to the slack or tolerance for movement of the wire core 204 as it further relates to the exposed length of the shield 202. The shield 202 becomes bunched up onto the side of the vertical disk ferrule 100 opposite the side which the terminal 300 and wire core 204 extend, which is from the front face 108*a*. As the vertical disk ferrule 100 moves along the axial direction of the wire 200, along the wire core insulation 206, and parallel to the wire 200, the wire core 204 extends, moves along, and through the opening 106 of the vertical disk ferrule 100. The wire braided shield portion 202 will consequently bunch up, or accordion, shown by letter A, into itself as the "take-up" of the wire 200 occurs. The wire braided shield 202 is bunched up from where it is exposed at the outer insulation 208 of the wire 200 to where it may contact the rear face 108*b* of the vertical disk ferrule 100. As further shown in FIG. 6D, once the wire braided shield 202 has become bunched or accordioned (as in portion A of the wire shield 202), this portion A of the wire shield 202 provides a force against the rear face 108*b* of the vertical disk ferrule 100 since the wire shield 202 is now pressed onto itself and is compressed while abutting against the vertical disk ferrule 100. Thus, more specifically, the wire braided shield 202 is bunched or accordioned in the space between the vertical disk ferrule 100 and the outer insulation 208, whereby the exposed portion of the wire braided shield 202 extends along the wire core insulation 206 and an end (flared portion F) is between the vertical disk ferrule 100 and accordioned portion A. Thus, this accordioned portion A of the wire braid shield 202 provides a spring-like force against the vertical disk ferrule 100 when the wire 200 is in this condition. The spring force provided by the wire shield 202 provides or assures that the front face 108*a* of the vertical disk ferrule 100 is pressed against and contacts a surface of the housing 400 and against such respective shielding means (not shown) inside or of the housing 400, while the vertical disk ferrule 100 further and also adequately covers an opening or aperture (not shown) in the housing 400.

The structural arrangements and methods of the vertical disk ferrule 100 of this invention also increase the electrical clearance of when in operation. In other words, by allowing the vertical disk ferrule 100 and the wire braided shield 202 (grounding circuit) to reside further away from the terminal 300 or wire core 204 (power circuit) as a result of the travel distance of the wire 200 into the connector housing 400, and the extension of the terminal 300 or wire core 204 away from the vertical disk ferrule 100, the electrical clearance is increased from those two components; and thus, in comparison to conventional ferrule structural arrangement and assembly, which has a conventional ferrule closer to the attached terminal.

The high voltage vertical disk ferrule 100 and method for assembling thereof of the present invention also eliminate the possibility of stray strands from the braided shield 202 (ground circuit) from contacting the power circuit (wire core 204) during the operation thereof. The flared portion F of the wire braided shield 202 of this invention is substantially perpendicular and "pulled back" and away from the wire core insulation 208 and wire core 204 when used with the vertical disk ferrule 100 of the present invention, and as explained previously, any stray strands of the wire braided shield 202 will advantageously not be in proximity to the power circuit when the high voltage vertical disk ferrule 100 of this invention is in use.

Figure 6E:
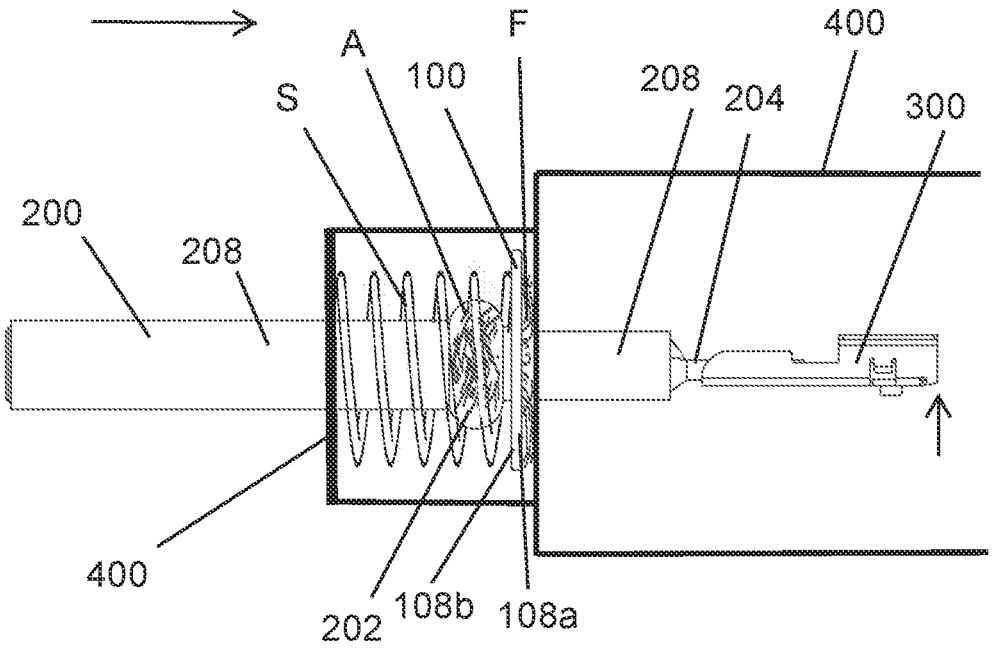
FIG. 6E is a side elevational view of the high voltage vertical disk ferrule of the present invention using the single high voltage vertical disk ferrule of the present invention and fully assembled with the wire, and the flared portion of the wire braided shield affixed on the front face of the high voltage vertical disk ferrule, the wire being fully inserted into the corresponding connector housing, and having a spring acting on the ferrule.

Further, as shown in FIG. 6E, the use of a spring S is also an option. The spring S is supported on one end by a cap (portion around spring) at an end of the housing 400 and provides a spring force against the rear face 108*b* or the wire braided shield 202 if on the rear face 108*b*, of the vertical disk ferrule 100 to allow the vertical disk ferrule 100 to be securely abutting against the wire braided shield portion 202 and a housing 400. With this structural arrangement, shown in FIG. 6E, the spring S can complement the spring force generated by the compression of the wire braided shield 202 during the operation thereof.

Although the foregoing descriptions are directed to the preferred embodiments of the invention, it is noted that other variations and modifications will be apparent to those skilled in the art, and may be made without departing from the spirit or scope of the invention. Moreover, structural arrangements or features described in connection with one embodiment of the invention may be used in conjunction with other embodiments, even if not explicitly stated above.

We claim:

1. A high voltage vertical ferrule for use in a corresponding connector housing that requires electromagnetic interference (EMI) protection, comprising:

a front face;

a rear face;

an outer edge; and an opening, wherein said front face is a flat surface, wherein said rear face is a flat surface, wherein a bunched or accordion-shaped portion is formed in said wire shield of said wire located between said rear face of said high voltage vertical ferrule and an outer insulation of said wire, wherein said outer edge defines a thickness of said ferrule, and wherein said opening of said high voltage vertical ferrule has an inner circumference directly attached to a wire core insulation.

2. The high voltage vertical ferrule according to claim 1, wherein said front face is substantially perpendicular to said outer edge.

3. The high voltage vertical ferrule according to claim 1, wherein said rear face is substantially perpendicular to said outer edge.

4. A high voltage vertical ferrule comprising: a first high voltage vertical ferrule and a second high voltage vertical ferrule, each said first and second high voltage vertical ferrule according to claim 1, wherein said first high voltage vertical ferrule includes a first front face and a first rear face, wherein said second high voltage vertical ferrule include a second front face and second rear face, and wherein said front face of said first high voltage vertical ferrule and said rear face of said second high voltage vertical ferrule face each other.

5. The high voltage vertical ferrule according to claim 4, wherein said front face of said first high voltage vertical ferrule and said rear face of said second high voltage vertical ferrule sandwich a wire braided shield of a wire shield of a wire into which said high voltage vertical ferrule is connected.

6. The high voltage vertical ferrule according to claim 5, wherein said wire braided shield of said wire is soldered, mechanically joined, or electro-mechanically joined to said first and second high voltage vertical ferrules.

7. A method for assembling a high voltage vertical ferrule for use in a corresponding connector housing that requires electromagnetic interference (EMI) protection and a wire, comprising the steps of:

inserting at least one ferrule over a wire shield of said wire;

pushing an end portion of said wire shield against said ferrule;

inserting an end portion of said wire into an opening of a connector housing;

resiliently contacting said end portion of said wire with a forward stop in said connector housing; and forming a bunched or accordion-shaped portion in said wire shield of said wire located between a rear face of said at least one ferrule and an outer insulation of said wire.

8. The method for assembling said high voltage vertical ferrule and said wire according to claim 7, wherein said step of inserting said ferrule over said wire shield of said wire includes a step of positioning said ferrule substantially perpendicular to said wire.

9. The method for assembling said high voltage vertical ferrule and said wire according to claim 7, wherein said step of inserting said ferrule includes one of: a step of pushing said ferrule against an end portion of said wire shield, and a step of pushing said end portion of said wire shield against said ferrule.

10. The method for assembling said high voltage vertical ferrule and said wire according to claim 7, wherein said step of inserting at least one ferrule includes the steps of;

a) inserting a first high voltage vertical ferrule over said wire shield of said wire;

b) pushing said end portion of said wire shield against said first high voltage vertical ferrule or pushing said first high voltage vertical ferrule against said end portion of said wire shield;

c) inserting a second high voltage vertical ferrule over a wire core insulation of said wire; and d) pushing said second high voltage vertical ferrule against said end portion of said wire shield.

11. The method for assembling said high voltage vertical ferrule and said wire according to claim 10, further comprising the step of sandwiching a flared portion of said wire shield of said wire between said first and second high voltage vertical ferrules.

12. A method for assembling a high voltage vertical ferrule for use in a corresponding connector housing that requires electromagnetic interference (EMI) protection and a wire having a wire core insulation, comprising the steps of:

pushing an end portion of a wire shield of said wire into a flared state;

inserting a ferrule over or directly connected to said wire core insulation of said wire;

pushing said ferrule against said flared state of said end portion of said wire shield; and forming a bunched or accordion-shaped portion in said wire shield of said wire located between a rear face of said high voltage vertical ferrule and an outer insulation of said wire.

13. The method for assembling said high voltage vertical ferrule and said wire according to claim 12, wherein said step of inserting said ferrule over said wire core insulation of said wire includes a step of positioning said ferrule substantially perpendicular to said wire.

14. The method for assembling said high voltage vertical ferrule and said wire with said connector housing according to claim 12, further comprising a step of attaching a terminal to said end portion of said wire.

15. The method for assembling said high voltage vertical ferrule and said wire with said connector housing according to claim 12, further comprising a step of contacting said flared portion of a wire braided shield of said wire shield with a shielding or a grounding of said connector housing.

16. The method for assembling said high voltage vertical ferrule and said wire according to claim 12, further comprising the steps of:

inserting an end portion of said wire into an opening of a connector housing; and contacting said end portion of said wire with a forward stop in said connector housing.

17. The method for assembling said high voltage vertical ferrule and said wire with said connector housing according to claim 16, further comprising a step of attaching a terminal to said end portion of said wire.

18. The method for assembling said high voltage vertical ferrule and said wire with said connector housing according to claim 16, further comprising a step of contacting a vertical surface of said ferrule with a shielding or a grounding of said connector housing.

* * * * *